US008825497B2

(12) United States Patent
Poulsen

(10) Patent No.: US 8,825,497 B2
(45) Date of Patent: Sep. 2, 2014

(54) SYSTEMS AND METHODS FOR REDUCING AUDIO DISTURBANCE ASSOCIATED WITH CONTROL MESSAGES IN A BITSTREAM

(75) Inventor: Jens Kristian Poulsen, Kitchener (CA)

(73) Assignee: BlackBerry Limited, Waterloo, Ontario (CA)

( * ) Notice: Subject to any disclaimer, the term of this patent is extended or adjusted under 35 U.S.C. 154(b) by 504 days.

(21) Appl. No.: 13/271,287

(22) Filed: Oct. 12, 2011

(65) Prior Publication Data

US 2013/0096931 A1 Apr. 18, 2013

(51) Int. Cl.
*G10L 19/00* (2013.01)

(52) U.S. Cl.
USPC ..... 704/501; 704/227; 704/228

(58) Field of Classification Search
USPC ..... 704/500–504, 227–228; 370/252
See application file for complete search history.

(56) References Cited

U.S. PATENT DOCUMENTS 7,365,669 B1 4/2008 Melanson
7,590,070 B1 * 9/2009 Asawa et al. ..... 370/252

FOREIGN PATENT DOCUMENTS

WO 2009045904 4/2009

OTHER PUBLICATIONS

The Society of Motion Picture and Television Engineers. Proposed SMPTE Standard for Television—Format for Non-PCM Audio and Data in an AES3 Serial Digital Audio Interface, SMPTE Journal, Apr. 2000.

Benjamin W. Wah, Xiao Su and Dong Lin. A Survey of Error-Concealment Schemes for Real-Time Audio and Video Transmissions over the Internet. Department of Electrical and Computer Engineering and the Coordinated Science Laboratory University of Illinois at Urbana-Champaign, Urbana, IL 61801, USA Dec. 2000.

Wen-Tsai Liao, Jeng-Chun Chen and Ming-Syan Chen. Adaptive Recovery Techniques for Real-Time Audio Streams. Electrical Engineering Department National Taiwan University, Taipei, Taiwan, ROC. Apr. 2001.

Prima LT Users Guide—Feature Overview and Model Description. Online at <http://www.musicamusa.com/techdocs/Manual/It/Ituser1.PDF>. Available as early as Apr. 2001.

European Patent Office. Extended European Search Report for European Patent Application Serial No. 11184889.1. Mailed Mar. 28, 2012.

* cited by examiner

*Primary Examiner* — Huyen X. Vo
(74) *Attorney, Agent, or Firm* — Bereskin & Parr LLP

(57) ABSTRACT

The embodiments described herein are directed to systems and methods for transmitting audio data and control segment in a single bitstream and reducing audio disturbance associated with the control segment when the bitstream is processed by an audio digital-to-analog converter. The system, according to one aspect, comprises a first audio unit, a transmitter coupled to the first audio unit, a receiver coupled to the transmitter, a second audio unit coupled to the receiver, a first processor coupled to at least one of the first audio unit and the transmitter, a second processor coupled to the second audio unit and the receiver, and an audio digital-to-analog converter connected to the second processor.

20 Claims, 15 Drawing Sheets

SYSTEMS AND METHODS FOR REDUCING AUDIO DISTURBANCE ASSOCIATED WITH CONTROL MESSAGES IN A BITSTREAM

FIELD

The embodiments herein relate to electronic devices, and in particular to systems and methods for reducing audio disturbances associated with control messages in a bitstream.

INTRODUCTION

Electronic devices, including portable electronic devices such as smart phones, have gained widespread use and may provide a variety of functions including telephonic services, electronic text messaging and other personal information manager (PIM) application functions.

Many such electronic devices include audio components such as microphones and speakers for capturing, transmitting, and producing sound. These audio components are often digital components that communicate by sending digital signals between one another. Often, the signals sent between two audio components are digital representations of sounds such as voice communications or music.

Two audio components may communicate with one another directly or indirectly in a variety of configurations when they are part of the same device or when they are part of separate devices. For example, two audio components could be a codec and a digital amplifier on a smart phone device or other portable electronic device.

DRAWINGS

For a better understanding of the embodiments described herein, and to show how they may be carried into effect, reference will now be made, by way of example, to the accompanying drawings.

Figure 14:
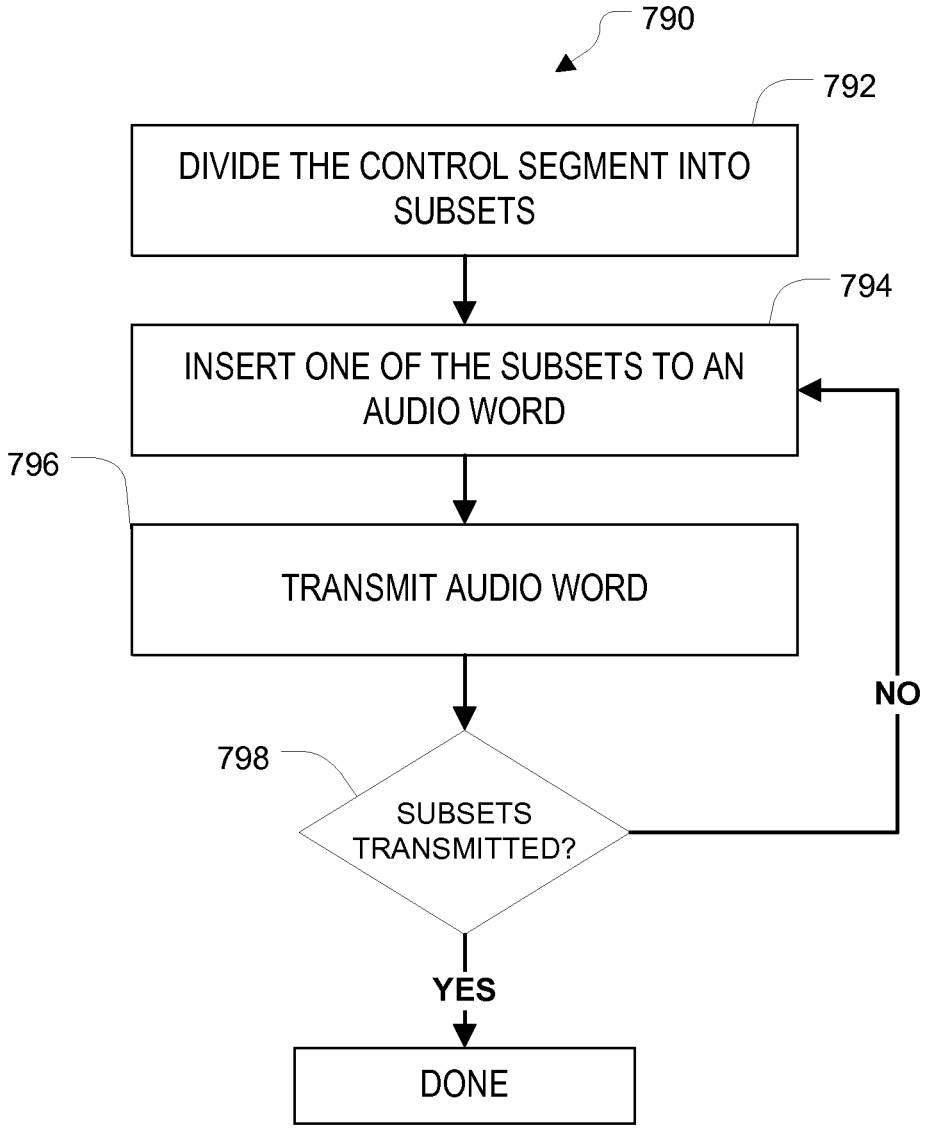
Figure 15:
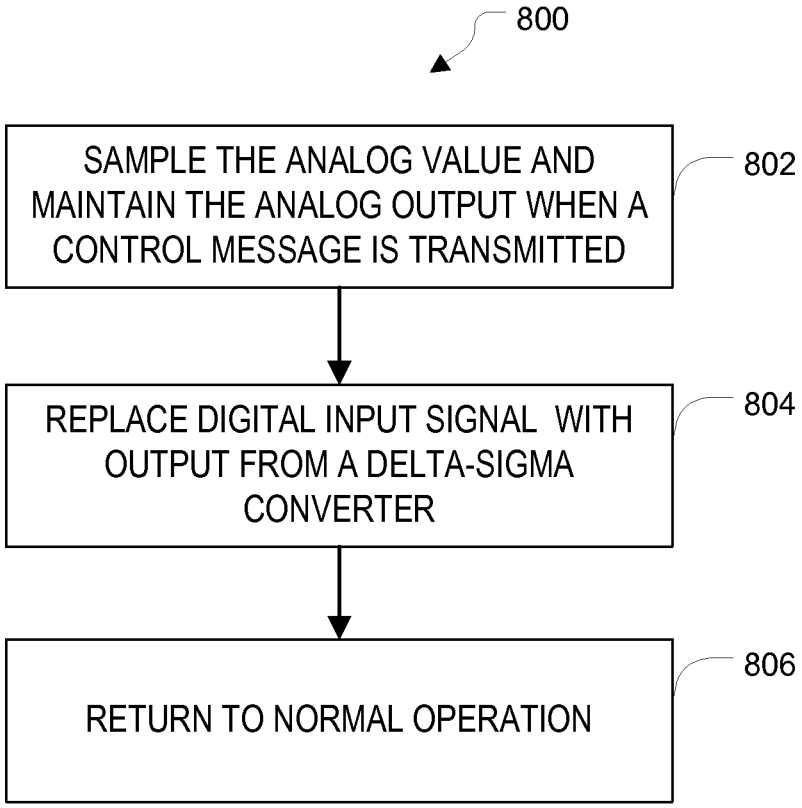

FIG. 14 is a block diagram illustrating a method for reducing audio disturbances associated with the control bits in a bitstream when the bitstream is converted to audio according to various embodiments; and FIG. 15 is a block diagram illustrating a method for reducing audio disturbances associated with the control bits in a bitstream when the bitstream is converted to audio according to various embodiments.

DESCRIPTION OF VARIOUS EMBODIMENTS

Generally, some embodiments as described herein may be implemented on one or more electronic devices, which may include a wide range of devices, such as mobile phones, smart phones, personal digital assistants (PDAs), personal or desktop computers, notebooks, laptops, digital audio/video players, digital audio/video recorders, tablet computers, and so on.

On some of these electronic devices, particular computer resources (e.g. memory capacity, processing power and screen space) may be more limited than on other devices. A portable smart phone, for example, may have a smaller display and less memory capacity than a personal computer, which may have a larger display and more memory. However, the concepts as described herein are not limited to any particular kind of electronic device, but are generally suitable for use on various electronic devices with various computer resources.

In some embodiments, the electronic device may be a portable electronic device, such as a smart phone or PDA, and which may have voice communication capabilities, data communication capabilities, or both, over one or more wired connections or a wireless connection.

According to one aspect there is provided an audio system having a first audio unit, a transmitter coupled to the first audio unit, a receiver coupled to the transmitter, a second audio unit coupled to the receiver, a first processor coupled to at least one of the first audio unit and the transmitter, a second processor coupled to the second audio unit and the receiver, and an audio digital-to-analog converter connected to the second processor. The first processor is configured to convert audio data associated with audio content to a bitstream comprising audio bits associated with the audio content, receive a control command selected from a plurality of control commands, in response, generate a control segment comprising a preamble and control bits associated with the control command, insert the control segment to the bitstream, and transmit the bitstream to the second audio unit using the transmitter. The second processor may be configured to monitor the bitstream for the preamble to detect the control segment, and if the control segment is detected, receive the control bits and execute the corresponding control command. The audio digital-to-analog converter is operable to process the bitstream to produce audio associated with the bitstream.

At least one of the first processor and the transmitter may be configured to change the oversampling frequency to a selected value while the control segment is being transmitted to generate sufficient bandwidth to send the control segment concurrently with the audio data.

According to another aspect there is provided a computer implemented method for encoding control messages in an audio system. The method includes converting audio data associated with an audio content to a bitstream comprising audio bits associated with the audio content, receiving a control command selected from a plurality of control commands, in response to the control command, generating a corresponding control segment comprising a preamble and control bits associated with the control command, changing the oversampling frequency to a selected value while the control segment is being transmitted to generate sufficient bandwidth to transmit the control segment concurrently with the audio data in the bitstream, inserting the control segment to the bitstream, transmitting the bitstream using a transmitter to a second audio unit, receiving the bitstream at the second audio unit using a receiver, monitoring the bitstream for bits associated with the preamble to detect the control segment, if the control segment is detected, processing the control message and executing the corresponding control command; and converting the bits in the bitstream to audio using an audio digital-to-analog converter connected to the second processor, operable to process the bits in the bitstream to produce audio associated with the bits in the bitstream.

According to another aspect, there is provided an audio system comprising a first audio unit, a transmitter coupled to the first audio unit, a receiver coupled to the transmitter, a second audio unit coupled to the receiver, a first processor coupled to at least one of the first audio unit and the transmitter, and a second processor coupled to the second audio unit and the receiver. The first processor is configured to convert audio data associated with audio content to generate a bitstream comprising audio bits associated with the audio content, receive a control command selected from a plurality of control commands, in response, generate a control segment comprising a preamble and control bits associated with the control command, insert the control segment to the bitstream, and transmit the bitstream to the second audio unit using the transmitter. The second processor is configured to monitor the bitstream for the preamble to detect the control segment, and if the control segment is detected, receive the control bits and execute the corresponding control command. The audio system also includes an audio digital-to-analog converter connected to the second processor operable to process the bitstream to produce audio associated with the bitstream. At least one of the first processor, transmitter, receiver, second processor is configured to generate an audio sequence comprising an estimate of the bitstream without the control segment, and replace the control segment with the audio sequence such that the control segment is not processed by the audio digital-to-analog converter to produce an audio disturbance.

In some aspects, the generated audio sequence is generated based on the spectral characteristics of the audio content. The audio sequence may be generated based on at least one of autoregressive, moving average, and autoregressive moving average model of the bitstream.

In some aspects at least one of the transmitter and receiver comprises a delta-sigma modulator. The delta-sigma modulator in the receiver may be configured to generate the audio sequence based on the DC-level measurement value of the audio bits in the received bitstream.

In some aspects the generated audio sequence comprises a first portion followed by a second portion, the first portion being based on a copy of the audio bits before the control segment and the second portion being based on a copy of the audio bits after the control segment.

In some aspects the generated audio sequence comprises a first portion followed by a second portion, the first portion being based on a copy of the audio bits before the control segment inverted in time and the second portion being based on a copy of the audio bits after the control segment inverted in time.

In some aspects the audio sequence is generated based on the shape of a sound wave associated with the audio content. The generated audio sequence may include at least one of a linear, parabolic and higher order model of the sound wave associated with the audio content.

In some aspects the generated audio sequence comprises bits that will produce a same mean value of the sound associated with the audio content before and after the control segment.

In some aspects at least one of the receiver, transmitter, first audio unit, and second audio unit further comprises a data storage device configured to buffer the audio bits in the bitstream. The audio sequence may be generated by rereading the audio bits buffered in the data storage device.

In some aspects the first processor is further configured to divide the control segment into a plurality of control subsets and transmit the control subsets at selected interval in the bitstream, and the second processor is configured to monitor the bitstream at the interval for the control subsets to reconstruct the control segment. In some aspects each control subset is one bit and each the control subset is inserted into the bitstream for each audio bit such that the interval is defined as every second bit in the bitstream being a control subset while the control segment is being transmitted.

In some aspects the transmitter and the receiver are configured to communicate via a bitstream interface consisting two terminals, the two terminals being a bit clock and a data line.

In some aspects the transmitter and the receiver are configured to communicate via a bitstream interface consisting three terminals, the three terminals being a bit clock, a word select and a data line.

In some aspects the transmitter is operable to detect audio bits that are identical to the preamble and change at least one of these audio bits before they are transmitted such that these audio bits will not be misinterpreted as the preamble by the receiver.

In some aspects the control segment is inserted into the bitstream by replacing at least some of the audio bits in the bitstream.

According to another aspect, there is provided a method for encoding control messages in an audio system, comprising converting audio data associated with an audio content to a bitstream comprising audio bits associated with the audio content, receiving a control command selected from a plurality of control commands, in response to the control command, generating a corresponding control segment comprising a preamble and control bits, inserting the control segment to the bitstream, transmitting the bitstream to the second audio unit using a transmitter to a second audio unit, receiving the bitstream at the second audio unit using a receiver, monitoring the bitstream for the preamble to detect the control segment, if the control segment is detected, processing the control bits and executing the corresponding control command, generating an audio sequence comprising an estimate of the bitstream without the control segment, and replacing the control segment with the audio sequence before the control segment is processed by the audio digital-to-analog converter.

In some aspects the audio sequence is generated based on the spectral characteristics of the audio content.

Various embodiments described herein relate to the communication of control signals within an audio system. In some embodiments, the communication occurs between a first audio unit and a second audio unit in an audio system. In some embodiments, the audio system may be a single device such as a portable electronic device (e.g. a smart phone). In some such embodiments, the first and second audio units can be components of the device. For example, the first audio unit may be a codec of the smart phone and the second audio unit may be an amplifier with one or more digital inputs. The first and second audio units may include a variety of different hardware components.

In some embodiments, the system may include more than one device, such as a smart phone and a headset device for use with the smart phone. In some such embodiments, the first audio unit may be a component of the headset device and the second audio component may be a component of the smart phone, or vice versa.

Various embodiments disclosed herein relate to sending control messages on a bus line along with or in place of audio data. In some embodiments, control messages are encoded in a bitstream. In other embodiments, the control messages are combined with the data bits in an audio interface that transmits audio data words, such as a standard $I^2S$ or PCM audio interface.

As used herein the term "audio data words" refers to bits or sets of bits that are processed in groups as words of data and that represent audio content. Bits "represent audio content" when they include any coded representation of one or more sounds (e.g. voice sounds, music, etc.)

Figure 1:
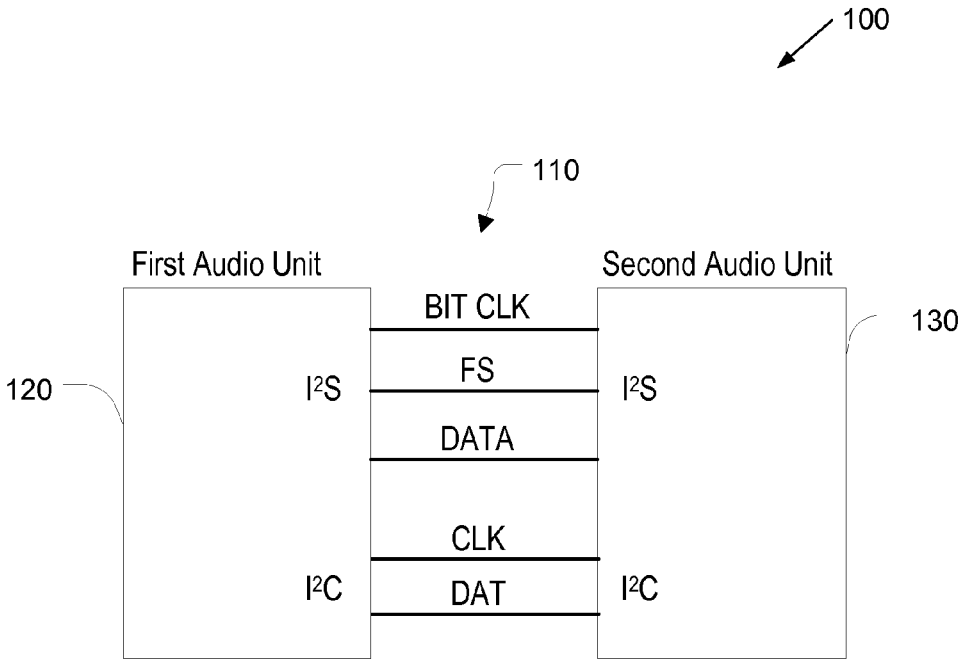
FIG. 1 is a schematic representation of a first known audio system.

Reference is now made to FIG. 1, which is a schematic diagram illustrating a first known audio system 100 having a known communication interface 110 between a first audio unit 120 and a second audio unit 130. As can be seen, interface 110 includes five terminals, and both the $I^2S$ and $I^2C$ interfaces are used (as further described below).

The $I^2S$ interface is also known as the Inter-IC Sound interface, and is an electrical serial interface standard that can be used to couple digital audio components together. The $I^2S$ interface uses three terminals: a bit clock, a word select, and a data line. Generally, the $I^2S$ interface allows for audio information to be sent between the first audio unit 120 and the second audio unit 130.

The $I^2C$ interface is also known as the Inter-Integrated Circuit interface, and is normally used to couple two or more integrated circuits together so that control and status information can be interchanged between these components. The $I^2C$ interface uses two terminals: a clock and a data line. Generally, the $I^2C$ interface allows for control signals to be sent between the first audio unit 120 and the second audio unit 130 over the data line. Accordingly, the interface 110 allows both audio information and control signals to be sent between the first audio unit 120 and the second audio unit 130. However, a total of five terminals are required for the interface 110 to operate.

Figure 2:
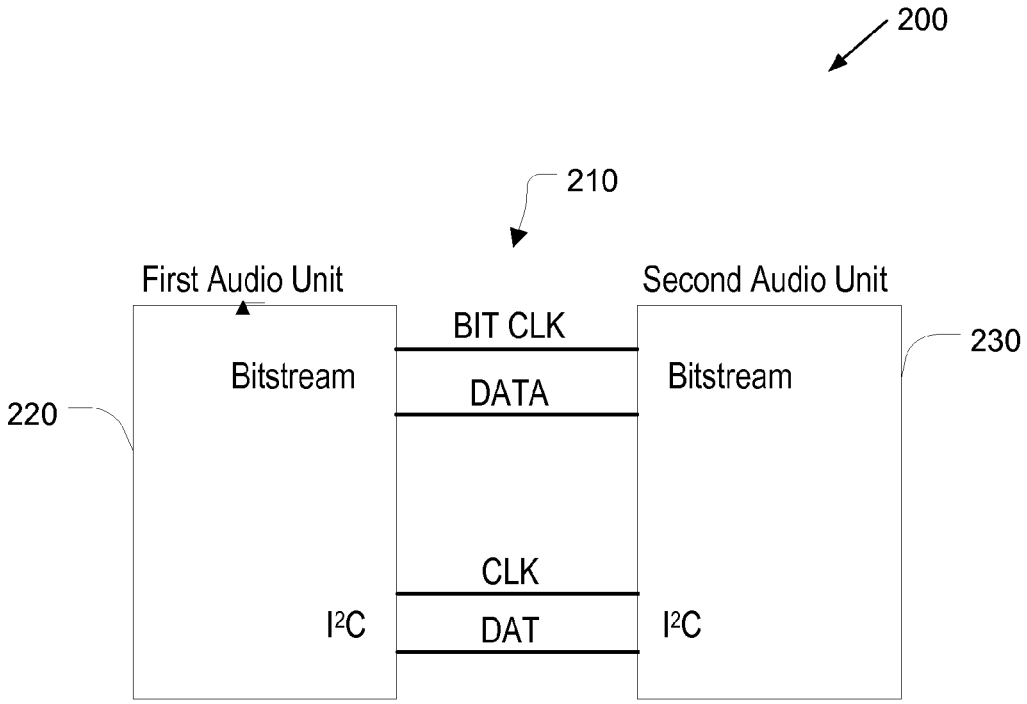
FIG. 2 is a schematic representation of a second known audio system.

Reference is now made to FIG. 2, which is a schematic diagram illustrating a second known audio system 200 including a known communication interface 220 between a first audio unit 220 and a second audio unit 230. As can be seen, the interface illustrated in FIG. 2 includes four terminals. The interface 220 uses both a bitstream interface and the $I^2C$ interface as described above.

The bitstream interface uses two terminals: a data line and a clock. The data line can carry bits that are a digitalized representation of sound. The bitstream is normally generated by a delta-sigma modulator but could also be obtained from a storage device or by other techniques. Generally, the bitstream interface allows for audio information to be sent between the first audio unit 220 and the second audio unit 230, while the $I^2C$ interface allows for control signals to be sent between the first audio unit 220 and the second audio unit 230. Accordingly, the interface 210 allows both audio information and control signals to be sent between the first audio unit 220 and the second audio unit 230 and provides similar functionally to interface 110. However, a total of four terminals are still required for the interface 210.

Each terminal normally adds to the expense of the overall hardware device. In general, the higher the pin count or number of terminals of an integrated circuit, the higher the cost. While in some cases, the additional cost per terminal may not in itself be significant, when a large quantity of devices are manufactured using that chip configuration, the overall costs can become very significant.

Figure 3:
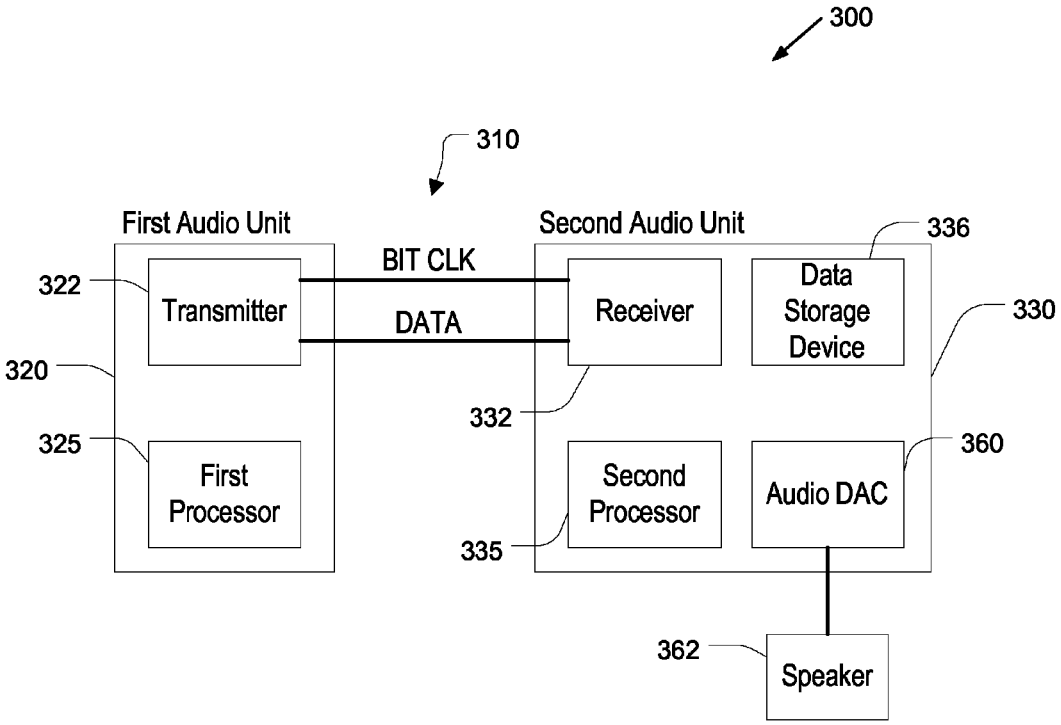
FIG. 3 is a schematic representation of an audio system for encoding control messages in an audio bitstream according to various embodiments.

Reference is now made to FIG. 3, which is a schematic diagram illustrating an audio system 300 for reducing audio disturbances associated with control messages in a bitstream according to one embodiment.

The audio system 300 includes a first audio unit 320 having a transmitter 322 and a first processor 325, and a second audio unit 330 having a receiver 332, a second processor 335, a data storage device 336 and an audio digital-to-analog converter 360.

As shown, the audio system 300 includes a data communication interface 310 between a first audio unit 320 and a second audio unit 330. The interface 310 facilitates data communication between the transmitter 322 and the receiver 332 such that information from the transmitter 322 may be sent to and received by the receiver 332. In some embodiments the transmitter 322 is a first integrated circuit and the receiver 332 a second integrated circuit, with the first and second integrated circuits coupled together through the interface 310.

As can be seen from FIG. 3, the interface 310 includes only two terminals, namely a clock line and a data line that connects the transmitter 322 to the receiver 332. Accordingly, the interface 310 uses fewer terminals compared to the interfaces 110, 210 described above. In some embodiments, the two terminals of the interface 310 are configured to be compliant with standard bitstream interfaces such as bitstream interfaces used by digital microphones.

In some embodiments, the interface 310 includes three terminals, namely a clock line, a word select line and a data line. In some embodiments the three terminals of the interface 310 are configured to be compliant with the $I^2S$ standard or a PCM interface.

In some embodiments, the transmitter 322 includes a transmitting delta-sigma modulator for transmitting a bitstream over the interface 310 to the receiver 332.

In some embodiments, the transmitter 322 comprises a transmitting sample-rate converter connected to the transmitting delta-sigma modulator. The sample-rate converter is operable to receive the output from the delta-sigma converter and change the oversampling value to a first value and a selected value that is different from the first value. The selected value is an oversampling value at which the control segment can be transmitted outside the audio band. However, when the control segment is not being transmitted, the sample-rate converter transmits the bitstream using the first oversampling value as the larger oversampling value improves the signal to noise ratio range.

In some embodiments, the receiver 332 includes a receiving delta-sigma modulator for receiving the bitstream over the interface from the receiver 322.

In some embodiments, the receiver 332 includes a receiving sample-rate converter connected to the receiving delta-sigma modulator. The sample rate converter is operable to receive the bitstream at the first and selected oversampling values and provide the received bitstream to the receiving delta-sigma modulator such that the delta-sigma converter receives samples with an equidistant sampling. In some embodiments the receiver 322 enables the receiving delta-sigma modulator to receive audio at different sample rates using a different integration constants.

In some embodiments, the first audio unit 320 may be more generally referred to as a first hardware element, and the second audio unit 330 may be more generally referred to as a second hardware element.

In some embodiments of the system 300, the first audio unit 320 may include a first hardware device and the second audio unit 330 may include a second hardware device. In some embodiments, one hardware device may be part of an electronic device, such as a portable communication device (e.g. a smart phone, cell phone etc.), a gaming device, a portable audio device (e.g. mp3 player, etc.) and so on, while the other of the hardware devices may be part of an audio emitting or receiving device adapted for use with the electronic device (such as a headset, a microphone, speaker, and so on).

In some embodiments, the system 300 may be provided on a single device (e.g., a smart phone, PDA, etc.). In such embodiments, the first audio unit 320 and the second audio unit 330 may both be components of the same device. For example, the first audio unit 320 may be a codec and the second audio unit 330 may be an amplifier with digital input on a smart phone device.

In embodiments where the first audio unit 320 is a codec, the codec may be implemented entirely in hardware. In some embodiments, the codec may include a processor executing software. In some embodiments, the processor executing software may be the first processor 325.

In some embodiments, the second audio unit 330 includes a digital amplifier. The digital amplifier may be a class D amplifier.

In the embodiment as shown in FIG. 3, the interface 310 includes a data line so that a bitstream may be sent from the first audio unit 320 to the second audio unit 330. Furthermore, the data line is operable to communicate the control messages from the first audio unit 320 to the second audio unit 330 (as will be further discussed below).

Generally, the bits on the bitstream associated with audio data are referred to as audio bits and the bits on the bitstream associated with control data (preamble and control message) are referred to as control bits.

In some embodiments, the first processor 325 may send control messages from the first audio unit 320 to the second audio unit 330 by altering the bitstream comprising audio bits by inserting control bits associated with a preamble and a control message selected from a plurality of control messages. In some embodiments the audio bits in the bitstream may be interrupted and the control bits may be sent, and after the transmission of the control bits, the transmission of the audio bits may resume. In some embodiments, the control bits may replace the audio bits.

In some embodiments, the bits from each control segment may be inserted as a single block comprising all the bits from the control segment or interleaved between audio data as a number of subsets comprising a portion of the control bits of the control message.

In various embodiments, the control segment may be based on or generated in response to a particular control command. The control command may be selected from a plurality of control commands. For example, a control command may be initiated by a user taking some action (e.g. adjusting a volume control using an input device, turning off the portable electronic device, etc.).

In some embodiments, a control command may be initiated or selected by the first audio unit 320 or another component of the audio system 300. In some cases, this may be done automatically without requiring user input. For example, a control command may be initiated based on a temperature reading indicating that a component of the system 300 has exceeded a temperature limit and that one or more components should be deactivated. In another example, the control command could be used as part of an initialization process of one or more components.

In some embodiments, one or more components of the system 300 can select a control command. The selection of a control command can occur in response to any appropriate criteria, such as the status of one or more components of the system (e.g. battery power level), a user input (e.g. a user selection), input from one or more other components of the system 300, input from another system or another component coupled to the audio system 300, and so on.

In some embodiments, the control command is provided to the first audio unit 320. When the first audio unit 320 receives the control command, the first audio unit 320 can then generate a corresponding control message. For example, a first processor 325 on the first audio unit 320 may be configured to receive a control command to power down a particular component on the second audio unit 330. In response, the first processor 325 generates an appropriate control message to be sent over the interface 310, which will trigger the desired action of powering down that particular component when the control message is received and processed by the second audio unit 330.

Generally, before the control message, in the form of control bits, is sent from the first audio unit 320 to the second audio unit 330, a preamble will be transmitted on the bitstream bus to indicate to the second audio unit 330 that a control message will be sent. For example, a preamble can be sent along the audio bitstream, and once the second audio unit 330 has identified the preamble, the second audio unit 330 will know that a control message will be forthcoming and can therefore properly recognize the control bits from the bitstream and interpret them as a control message (and not as audio bits). The second audio unit 330 can then execute the control command associated with the control message (e.g. powering down a particular component, etc.).

In some embodiments, the first processor 325 is coupled to the first audio unit 320 and is operable to generate the control bits associated with the preamble and control message to be sent via the bitstream.

It is desirable for the receiver 332 to be compatible with devices that do not provide control bits. To facilitate this compatibility, in some embodiments, the receiver 332 may operate in a first operating mode and a second operating mode. The first operating mode may be used with components that do not provide control bits and the second operating mode may be used with components that do provide control bits.

In the first operating mode, the receiver 332 may ignore control messages. For example, the receiver 332 may receive the control bits, identify them as bits of a control message but not execute the associated control command. In another example, the control bits may be discarded or be treated as audio bits.

However, to facilitate switching between modes based on a control message, the receiver 332 in the first operating mode may recognize a control message that indicates to the receiver 332 to switch operating mode between the first operating mode and the second operating mode. That is, the receiver 332 may ignore all control messages in the first operating mode except for the control message to switch between the first and second operating modes. The length of the control message to switch between the first operating mode and the second operating mode may be very long to reduce the chance of the control message occurring in the audio bits by chance.

In the second operating mode, the control bits may be recognized and executed as described herein.

In some embodiments, the first audio 320 includes the first processor 325. In other embodiments, the first processor 325 is separate from the first audio unit 320.

In some embodiments, a second processor 335 is coupled to the second audio unit 330, and is operable to monitor the bitstream to detect the preamble. This may be implemented using a state machine. Once the preamble is detected, the second processor 335 can monitor the bitstream to detect the control bits associated with a control message. Once a control message has been detected, the second processor 335 can execute the corresponding control command.

In some embodiments, as shown, the second audio unit 330 includes the second processor 335. In other embodiments, the second processor 335 is separate from the second audio unit 330.

In some embodiments, the control message will be sent immediately after the preamble is transmitted on the bitstream. In other embodiments, the control message may be sent at another time (e.g. after a particular time delay, after a particular number of bits have been sent, and so on).

In various embodiments, the preamble and the control message may be sent by altering the bitstream that would otherwise have been sent. For example, the bitstream may be interrupted or replaced. Accordingly, in some embodiments, a bitstream that precedes the sending of the preamble is interrupted by the preamble and control message, and then resumes after the control message has been sent. In some embodiments, the portions of the bitstream may be replaced by the bits of the control segment, which may result in missing audio bits.

Generally, an audio sequence comprising an estimate of the missing audio bits may be generated as described herein according to various embodiments to minimize audio disturbances when the bitstream is processed by an audio digital-to-analog converter 360. In some embodiments, the control segment may be sent in the bitstream in addition to and without replacing any of the audio bits as described herein.

As used herein the term "replace" generally refers to setting a value of an audio bit to a selected value. In some embodiments, this may be done by simply altering bits to produce the desired values, while in other embodiments this may be achieved by multiplexing various sources of bits.

In some embodiments, replacing the audio bits can include altering bits, such as by reversing a value of one or more bits (e.g. flipping one or more '0's to '1's, and vice versa).

Generally, the combination of the preamble and the control message in the bitstream may be referred to as a control segment in the bitstream. That is, the control segment comprises control bits associated with the preamble and the control message.

Figure 4:
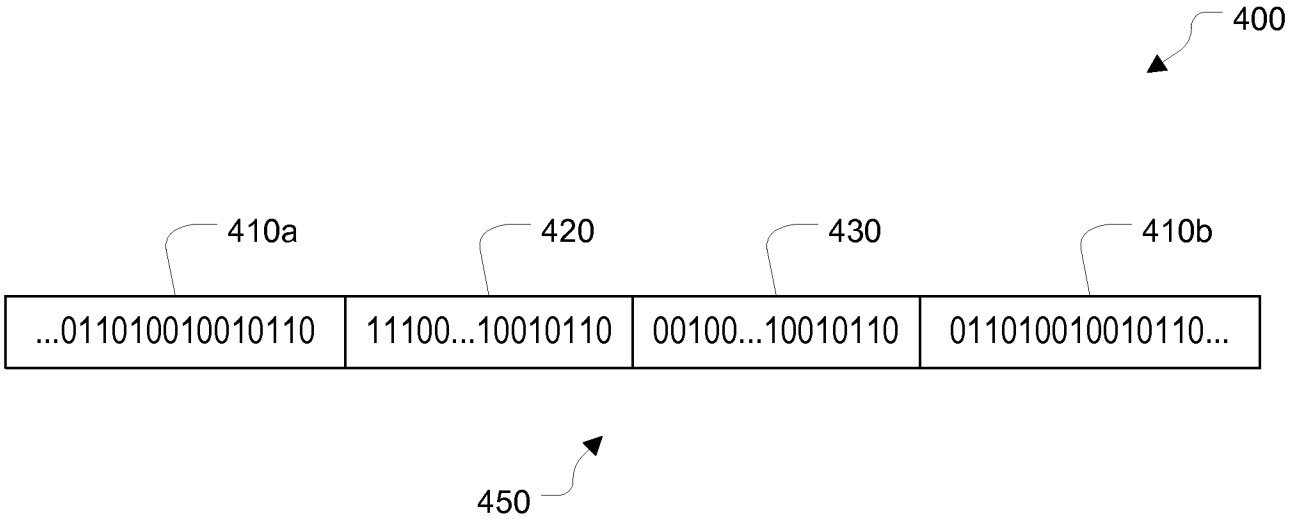
FIG. 4 is a block diagram of an exemplary bitstream that can be transmitted using the interface of the system of FIG. 3.

Reference is now made to FIG. 4, which illustrates an example bitstream 400 that may be transmitted over the data line of the interface 310 of FIG. 3 according to some embodiments. As shown, the bitstream 400 includes a first portion 410*a* comprising audio bits of a bitstream 400 followed by a preamble 420. The preamble 420 in turn is followed by a control message 430. The combination of the preamble 420 and the control 430 forms a control segment 450. After the control segment 450, the audio bits of the bitstream 400 resume (as indicated by the second portion 410*b* of the audio bitstream 410). Accordingly, the first and second portions 410*a* and 410*b* comprises audio bits and the control segment 450 comprises control bits.

In some embodiments, the preamble 420 could be composed of a mixture of audio bits and the bits of the preamble itself. In some embodiments the control message 430 is composed of a mixture of the bits of the control message itself and audio data.

In some embodiments, the preamble may not necessarily be any specific data values. For example, the preamble may comprise a change in oversampling rate. That is, if the receiver 332 detects a change in oversampling rate, the receiver 332 may monitor the bitstream 400 for the control segment that is being transmitted.

In some embodiments, the first processor 325 is programmed to insert the control segment 450 in the bitstream associated with all the audio data channels (e.g. both the left and right). In other embodiments, the control segment may be inserted in only one of the audio channels. For example, the control segment 450 may be inserted to the portion of the bitstream associated with only one of the left, right, center, surround, and subwoofer channels.

The bitstream 400 is received at the second audio unit 330. In some embodiments, as shown in FIG. 3, the second audio 330 unit comprises an audio digital-to-analog converter 360 to process the received bitstream 400 and convert the audio data in the bitstream 400 to sound associated with the audio data, which can be amplified by an audio emitting or receiving device, such as a speaker 362. However, since the bitstream 400 contains control bits associated with the control segment 450, which are not audio bits, processing these control bits as audio data will, in many cases, result in undesirable audio disturbance such as "clicking" sounds or distortions. Such audio disturbances may diminish user experience therefore it is generally desirable to reduce such audio disturbances.

To reduce these audio disturbances, at least one of the components of the system 300, namely the first processor 325, transmitter 322, receiver 332, second processor 335 or the audio digital-to analog converter 360 may be adapted to reduce such audio disturbances as further described below.

For example, in some embodiments, at least one of the transmitter 322 and receiver 332 comprises a delta-sigma modulator. The delta-sigma modulator in the transmitter 322 may be configured to change the oversampling ratio from a first value to a selected value such that the control bits can be concealed outside the audible band. In one embodiment, this can be done by utilizing the free bandwidth obtained when a lower oversampling ratio is used to transfer the control bits. This may result in a slightly higher noise floor during the transmission, but generally will not disturb the audio that is rendered.

The corresponding delta-sigma modulator in the receiver 332 may be configured to change the oversampling frequency to the same value as the selected value such that the control bits can be determined. In this embodiment, the control segment is inserted into the bitstream in addition to and without replacing any of the audio bits.

In some embodiments, the bitstream sequence may be replaced by an oversampled-by-32-bits sequence, before and/or after the control segment, to remove artifacts. As an example, 2*N bits before the control segments may have the property that N bits are repeated twice (i.e. having the same value) thereby indicating to the receiver 332 that a control segment will be provided in the following bits. For example, for the next M bits, the control and audio bits are provided in a bit-by-bit alternating manner. The values N and M are integers, and N may be greater than or equal to 32 and M may be greater than or equal to 16. In the receiver 332, a buffer (for e.g. data storage device 336) holding 2*N values may be used to inhibit the bitstream containing audio bits and control bits from being rendered as sound before they are processed and enable the switching to a lower sample frequency before the buffer has been emptied. After the control segment has been transmitted, the receiver 332 and transmitter 322 will both switch back to the higher oversampling rate to decrease the noise floor.

In some embodiments, the delta-sigma modulator in the receiver 332 may be used to generate an audio sequence comprising audio bits that have similar audio characteristics as the audio bits in the bitstream transmitted (i.e. the bitstream without the control segment 450).

In some embodiments, at least one of the first processor 325 and the second processor 335 may be operable to obtain a measurement of a DC-level of the bitstream, generate the audio sequence and based upon the DC-level, switch between the actual bitstream and the audio sequence such that the audio sequence (without the control bits) is provided to the audio digital-to-analog converter 360. In some embodiments the audio digital-to-analog converter 360 could be a delta-sigma modulator. The model bitstream may be generating using a delta-sigma converter to generate a series of zeros and ones that approximate the original probability of zeros and ones in the original bitstream before including the control segment.

In some embodiments, the delta-sigma modulator comprises a dither generator, the dither generator being configured to send the bitstream to the receiver 332 such that the control segment is sent outside the audio bandwidth. A dither generator may be provided within delta-sigma generators to remove tonal activity from the audio band. By choosing specific dither patterns, it is possible to cause modulation of the bitstream outside the audio bandwidth. This implementation would provide a low bandwidth data link with no interference to the audio data. For example, two different high frequency tones may be used to modulate the delta-sigma modulator thereby providing dithering. This will result in different spectral characteristics out of the audio band and can be used to distinguish between these two patterns. The messages between the transmitter 322 and the receiver 332 would typically be register write operations. In some embodiments, the dither generator includes special spectral shaping to minimize (or at least reduce) spectral leak to the audible band.

In some embodiments, the transmitter 322 and the receiver 332 may be configured to transmit the control segment in a bandwidth above the audible bandwidth, such that when the bitstream comprising the control segment is processed by the audio digital-to-analog converter 360, the sound associated with the control segment is inaudible to a listener. The transmitter 322 in such embodiments may be configured to modify the transmission through spectral shaping of the control pulses, e.g. by adding out-of-band control signals associated with the control segment to the input of a delta-sigma converter and the receiver 332 may be configured to receive the modified transmission.

The control signals that are added to the transmitters 322 delta-sigma converter may be of low amplitude to avoid disturbing the audio and to avoid decreasing the maximum allowed audio signal level without distortion such that the signal to noise ratio (SNR) will still be of acceptable quality. Generally, the sampling frequency of the delta-sigma converter should be a multiple of the signal tones that are used, for example, 16 or 32 times lower than the sampling frequency.

In some embodiments, the second processor 335 is configured to generate an audio sequence estimate of the audio bits that were replaced by the control bits of the control segment, and replace the control segment such that the control segment is not processed by the audio digital-to-analog converter 360 which may otherwise produce an audio disturbance.

In some embodiments, the second processor 335 may be programmed to generate the audio sequence by copying audio bits from the bitstream immediately before and after the control segment. For example, referring again to FIG. 4, the audio sequence may be a combination of a portion of the bitstream 410*a* immediately before the control segment 450 and a portion of the bitstream 410*b* immediately after the control segment 450.

In some embodiments, the generated audio sequence comprises a first portion followed by a second portion. The sources of the values for the first portion and the second portion may be different. For example, the first portion may include a copy of the audio bits 410*a* before the control segment 450 and the second portion may include a copy of the audio bits 410*b* after the control segment 450.

In another example, the first portion may include a copy of the audio bits before the control segment 450 inverted in time while the second portion may include a copy of the audio bits after the control segment 450 that are inverted in time.

In some embodiments, the audio sequence comprises at least one of a linear model, a parabolic model, and a higher order model (e.g. $3^{rd}$ order, $4^{th}$ order, etc.) of the bitstream. The model may take into account that the density of the zeros and ones in the bitstream may be changing and a more accurate model of the missing segments of data may be modeled using a dynamic model of the bitstream density.

In some embodiments, the second processor 335 is programmed to generate the audio sequence based on the audio content, for example, the properties of the sound produced when the audio bits before or after the control segment (or both) are played back. In some embodiments, the audio sequence comprises at least one of a linear, parabolic and higher order model of the sound associated with the audio content.

In some embodiments, the audio sequence comprises a mean value of the sound associated with the audio bits before or after the control segment (or both) when the audio bits are played back.

In some embodiments, the mean value could be a mean of the sound pressure level of the sound. In some embodiments, the mean value could be the mean of the frequency value of the sound. In some embodiments, the mean value could be a mean of any other measured value of the associated sound.

In some embodiments, the audio sequence comprises bits with a similar spectral content as the audio content. For example, the audio sequence, when played back may have similar or identical spectral content as the audio content when the audio content is played back. The spectral content of the audio content immediately before and after the control segment may be used for comparison.

In some embodiments, the audio sequence may be generated based on at least one of these adaptive filter models: an autoregressive model, a moving average model, and an autoregressive-moving average model of the bitstream. The adaptive filter may operate in a learning mode or an active mode. In the learning mode, the spectral characteristics of the input signal (e.g. the audio content) is obtained. In the active mode, a white noise signal is passed on to the adaptive filter and the spectral output of the filter will have similar characteristics as the audio content before the control message is transmitted. The output from the adaptive filter will be typically passed onto a delta-sigma converter in order to generate an audio output bitstream.

In some embodiments, at least one the first audio unit 320 and second audio unit 330 further includes at least one data storage device (e.g., data storage device 336) that may be used as a data buffer. The data buffer may be used to temporarily store a portion of the audio data stream. In some examples, the buffer may be implemented as a circular buffer or first in first out (FIFO) buffer in order to efficiently store and retrieve data.

If the control segments are of a fixed length, in some examples the size of the data buffer may only need to be large enough to accommodate audio data of the same length as the control segment.

Figure 5:
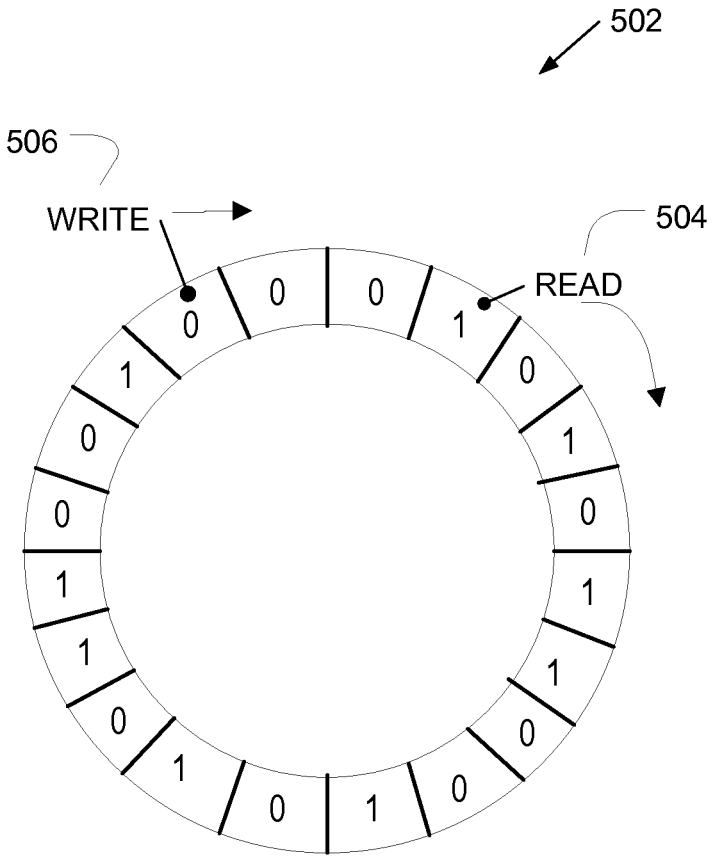
FIG. 5 is a schematic representation of a data storage device that is logically organized as a circular data buffer, and which may be found in the second audio unit shown in FIG. 3.

Referring to FIG. 5, illustrated there in is an exemplary data buffer 502 logically organized in a circular manner (e.g. a circular buffer). The data buffer 502 may be implemented using a data storage device. In the embodiments when the length of the control segment is known, the amount of data that can be stored in the data buffer 502 could be the same as the length of the control segment. The data that is being read is indicated by the "Read" indicator 504 and the data that is being written is indicated by the "Write" indicator 506. Both of the indicators 504 and 506 are moving in the same direction.

In the embodiment as shown, they are both moving in the clockwise direction. While the storage elements has been shown to be logically organized in a circular manner, in practice, the circular buffer will often be implemented using binary arithmetic and utilize the fact that index values wrap around when adding one to the highest numerical index value and ignoring the carry (i.e "11111"+"00001"="00000" when using a 32 element long storage buffer).

When a control segment is detected, the "Write" function may be suspended for the duration of the control segment, so that the "Read" function will re-read the same data from the buffer 502 (e.g. equal to the bits written to the buffer 502 prior to the suspension of the Write function). That is, the audio sequence is being generated by rereading the same audio bits from the data buffer 502. After the bits corresponding to the control segment 450 have passed, the Write function can then resume, which will write supplemental audio data into the data buffer 502 in a normal fashion.

In another embodiment, the "Read" function may begin to read elements back in the reverse order when the "Write" function is suspended, which generates an alternative approximation of the bitstream.

In some embodiments, the second audio unit 330 further comprises an analog control loop that reduces the audio disturbance produced by the control bits associated with the control segment when those bits are processed by the audio digital-to-analog converter 360. This can be done by implementing a sample-and-hold circuit in the receiver 332 that is activated when the control segment is received and thereby holding the last value written.

If a delta-sigma converter is used in the receiver 332, the clocking may be disabled during the control segment, so that the control segment will not affect the history inside the delta-sigma converter, which may be either stored as charges in an analog circuit implementation or as numerical values in a digital implementation.

In some embodiments, the first processor 325 is programmed to send the bits associated with the control segment by breaking up the control segment into a plurality of subsets of control bits, and then sending the subsets of control bits over an interval until the entire message is sent. For example, a single subset containing one or more control bits may be inserted in an audio word and sent along with audio word to the second audio unit 330. The interval may be selected to be every second value such that a control subset comprising a single control bit is placed next to an audio bit in the bitstream such that every second value is a control bit. This step may be repeated until all of the control subsets are sent to the second audio unit 330 over a plurality of audio words.

The second processor 335 may be programmed to reconstruct the control segment by recognizing the control subsets associated with the control segment from the plurality of audio words. The second processor 335 will be aware of the interval that is selected by the transmitter 322 so that it will know where in the bitstream to monitor for control subsets.

This technique tends to reduce the size of the data gap caused by the bits corresponding to the control segment 450, which may reduce the undesirable audio distortion when the bitstream 400 is played back by the audio digital-to-analog converter 360. The distortion may be further reduced by modifying the oversampling rate to match the bandwidth requirements of the control segment that is being transmitted simultaneously.

In some embodiments, the portions of the control segment may be transmitted in consecutive audio words. In other embodiments, non-consecutive audio words may carry the portions of the control segment 450. For example, every second, third, fourth, etc., audio word can carry one or more bits associated with the control segment 450.

In some embodiments, the least significant bit of each audio word may be replaced with a bit corresponding to the control segment 450. Replacing only the least significant bit (LSB) of an audio word may minimize the distortion of the audio content (and in some embodiments may make the distortion inaudible). This embodiment is particularly suitable for $I^2S$ communication, where changing the LSBs, generally, will not cause the audio that is rendered to change, but provides an effective way of including control messages simultaneously with audio data. In this embodiment, two fewer connections (and wires) are required in comparison to using $I^2S$ and $I^2C$ communication simultaneously, which can reduce system cost and space requirement.

Figure 6:
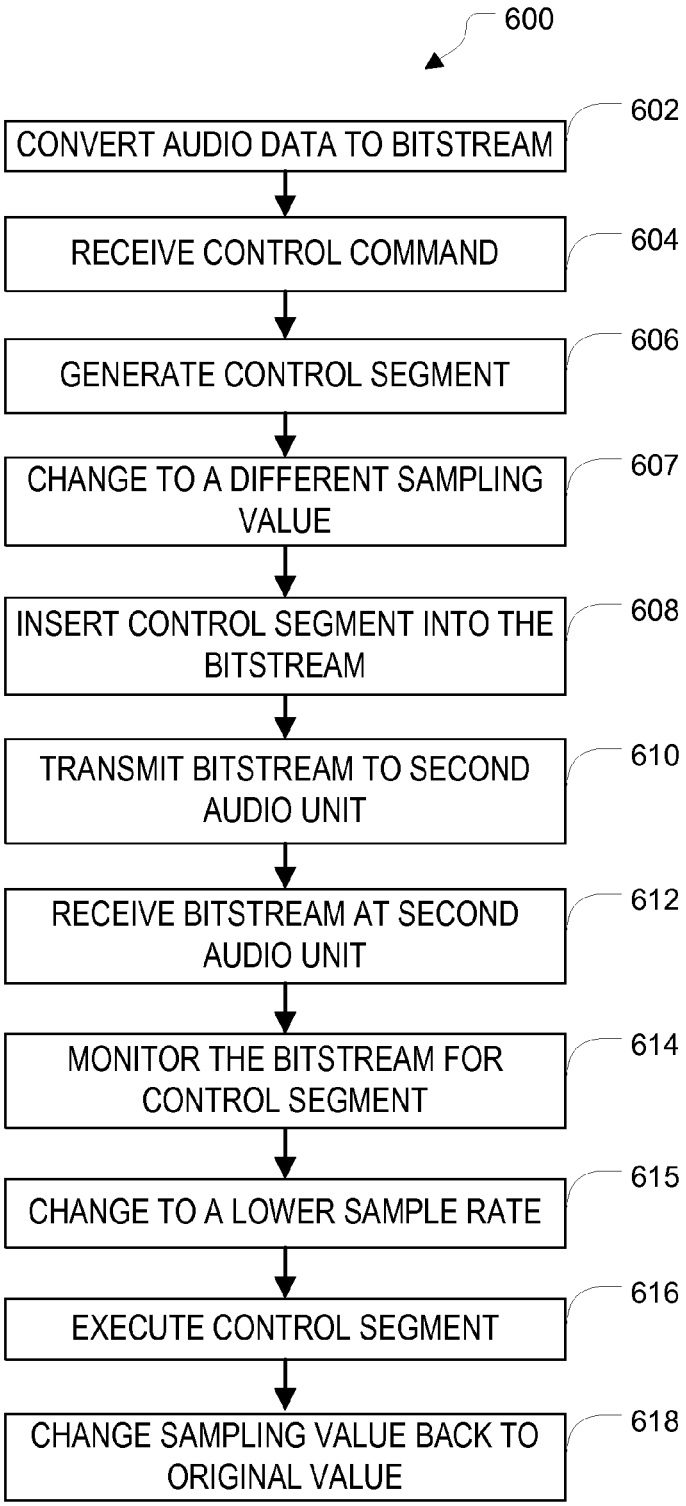
FIG. 6 is a block diagram illustrating a method for reducing audio disturbances associated with control messages in a bitstream according to various embodiments.

Reference is now made to FIG. 6, which is a flow chart diagram illustrating a method 600 for reducing audio disturbances associated with control messages in a bitstream according to one embodiment. In some embodiments, the method 600 may be implemented by the components of the audio system 300 shown in FIG. 3 and described above. In other embodiments, the method 600 may be implemented by components of an audio system that is different from that of the audio system 300.

At step 602, the method 600 converts audio data associated with an audio content into a bitstream comprising audio bits associated with the audio content.

At step 604, the method 600 receives a control command selected from a plurality of control commands.

At step 606, in response to the control command, the method 600 generates a control segment comprising a preamble and a control message corresponding to the selected control command.

In some embodiments, at step 607, the system may change the oversampling value to a selected value while the control segment is being transmitted to generate sufficient bandwidth to transmit the control segment and the audio data in the bitstream. The receiver will use a corresponding oversampling value when the control segment is being received.

At step 608, the method 600 inserts the control segment into the bitstream. In some embodiments, the control segment may replace one or more audio bits in the bitstream. In other embodiments, the control segment may be inserted in addition to and without replacing the audio bits in the bitstream.

At step 610, the method 600 transmits the bitstream using a transmitter (e.g. transmitter 322) to the second audio.

At step 612, the method 600 receives the bitstream (e.g. at the second audio 330 unit using a receiver 332).

At step 614, the method 600 monitors the bitstream for the preamble to detect the control segment.

At step 616, if the control segment is detected in step 614, the method processes the control message and executes the corresponding control command.

At step 618, the over sampling value is changed from the selected value to the original value.

In some embodiments, the method 600 may further comprise one or more steps from the methods described below to reduce the audio disturbance caused by the control segment when the control segment is processed by the audio digital-to-analog converter.

For instance, in some embodiments, the method 600 may further comprise the following steps. The method 600 may comprise generating an audio sequence comprising an estimate of the bitstream without the control segment by at least one of the first processor, transmitter, receiver, and second processor.

The method may also comprise the step of replacing the control segment with the generated audio sequence such that the control segment is not processed by the audio digital-to-analog converter to produce an audio disturbance.

In some embodiments, the method 600 may further comprise one or more steps from one or more methods described below to reduce the audio disturbance associated with control bits in the bitstream when the bitstream is processed to generate the sound associated with the bits of the bitstream. In some embodiments, these steps may be performed in conjunction with, or in addition to, one or more of the steps described above. In some embodiments, one or more of the steps listed below may be performed instead of one or more of the steps mentioned above. In some embodiments, the method 600 may incorporate steps from more than one of the methods described below.

Figure 7:
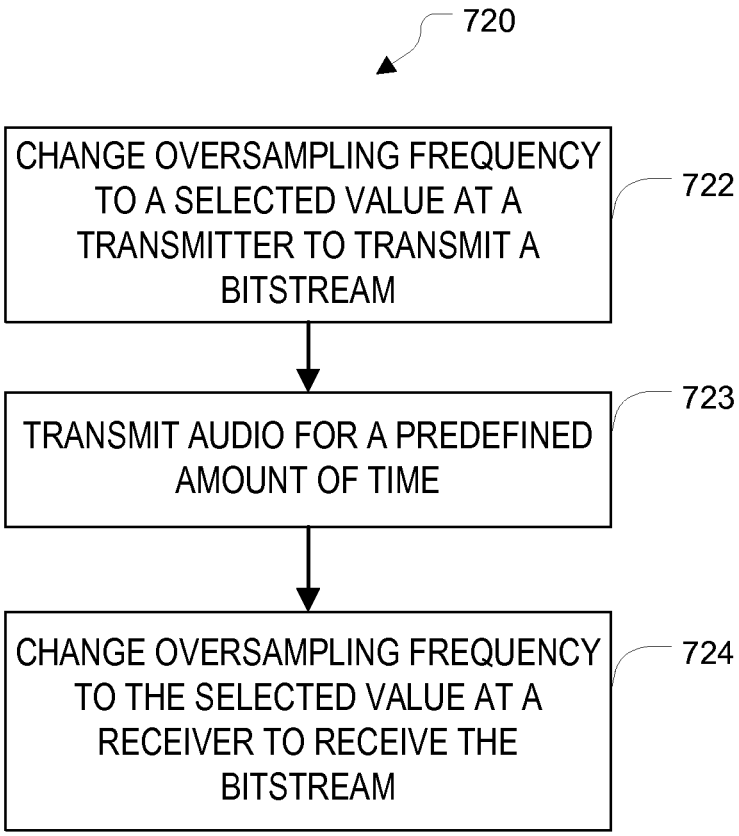
FIG. 7 is a block diagram illustrating a method for reducing audio disturbances associated with the control bits in a bitstream when the bitstream is converted to audio according to various embodiments.

Referring now to FIG. 7, illustrated therein is a method 720 for reducing the audio disturbance associated with control bits in a bitstream when the bitstream is processed to generate the sound associated with the bits of the bitstream.

At step 722, the method 720 changes the oversampling value to a selected value (e.g. using a delta-sigma modulator in a transmitter) such that bandwidth is allocated for the control segment to be transmitted concurrently with the audio bits. The selected value is generally lower than a value that is used when only audio bits are transmitted on the bitstream.

At step 723, the transmitter will first transmit the bitstream with audio bits only for a selected amount of time at the selected oversampling value to indicate to the receiver that the oversampling value has been changed. The transmitter may include a counter that has counted previous bits that could look like a control segment so that the receiver is able to determine when the control segment starts. For example, the receiver may recognize that the control bits will arrive after a selected number of audio bits are received at the lower frequency. To facilitate this, the receiver may monitor the received bits by counting the number of bits that are equal in pairs.

In some embodiments, the transmitter may transmit a series of audio bits in a predefined pattern in the bitstream to the receiver to indicate that the oversampling value has been changed. The receiver is correspondingly configured to monitor the bitstream for the pattern to determine that the oversampling frequency has been changed.

At step 724, the method 720 uses a delta-sigma modulator in the receiver to change the oversampling value to the selected value (i.e. the same value as used in the transmitter) such that the audio data can be correctly processed and the control segment can be extracted. After the control segment has been received, both the transmitter and receiver return to the original higher oversampling ratio value.

In some embodiments, the transmitter is operable to detect audio bits that are identical to the preamble and change at least one of these audio bits before they are transmitted such that these audio bits will not be misinterpreted as the preamble of a control segment.

Figure 8:
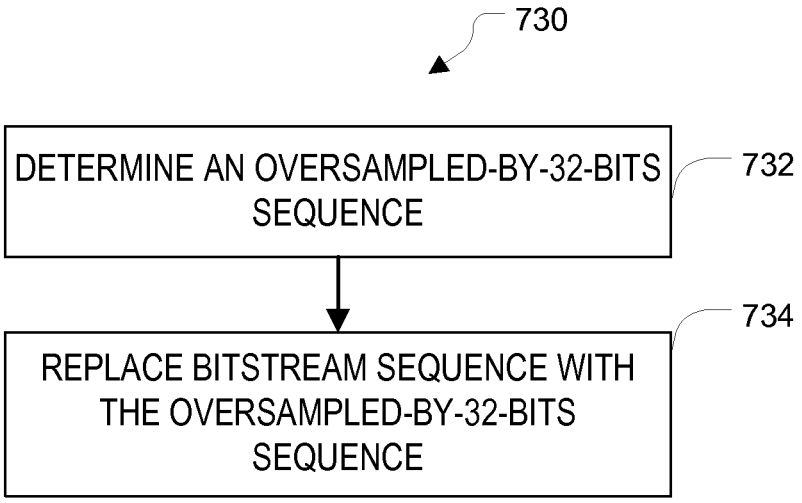
FIG. 8 is a block diagram illustrating a method for reducing audio disturbances associated with the control bits in a bitstream when the bitstream is converted to audio according to various embodiments.

Referring now to FIG. 8, illustrated therein is a method 730 for reducing the noise associated with control bits in a bitstream. At step 732, the method 730 determines an oversampled-by-32-bits sequence using a delta-sigma modulator with different coefficients or by processing the output from a delta-sigma converter with a sample-rate converter.

At step 734, the method 730 replaces the bitstream sequence with the oversampled-by-32-bits sequence, before or after the control segment (or both) to remove artifacts that could happen by playing back control signal. These artifacts could manifest themselves as a higher noise floor, impulse noise, tones in the passband or distortion. During the transmission of the control segment in the bitstream, only every second value of the bitstream may contain the control bits associated with the control segment. That is, control and audio data will be transmitted in a bit-by-bit alternating manner. In some embodiments, oversampling values other than 32 and other ratios between the two chosen oversample rates may be used as the oversampling ratio.

Figure 9:
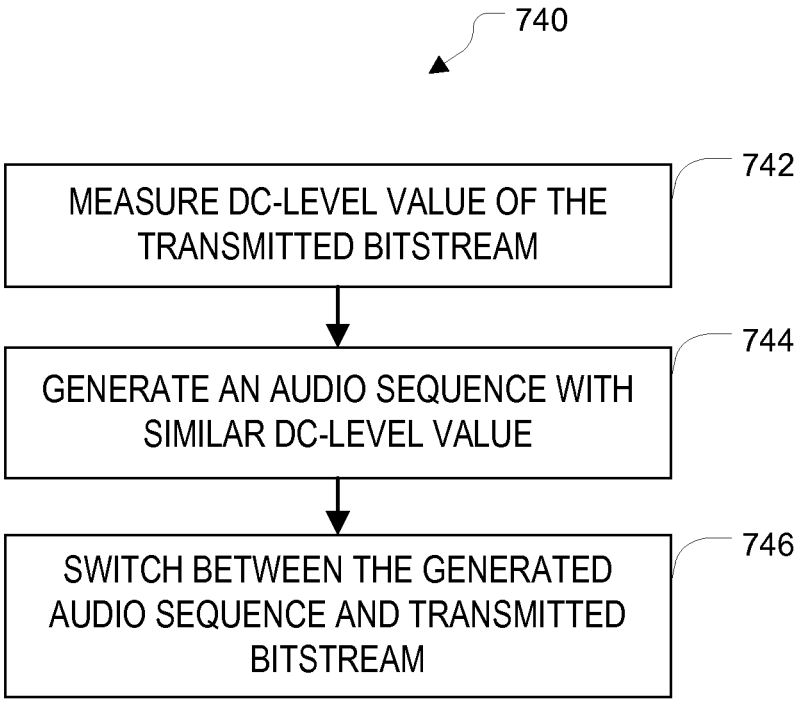
FIG. 9 is a block diagram illustrating a method for reducing audio disturbances associated with the control bits in a bitstream when the bitstream is converted to audio according to various embodiments.

Referring now to FIG. 9, illustrated therein is a method 740 for reducing the audio disturbance associated with control bits in a bitstream according to another embodiment.

At step 742, the method 740 obtains a measurement of a DC-level value of the bitstream that is being transmitted. This measurement may be performed in the receiver and involves estimating the density of binary values, i.e. zeros and ones that are being received.

At step 744, the method 740 generates an audio sequence comprising bits similar to the bitstream without the control segment sent by the first audio unit based on the DC-level value obtained in step 742. That is, the audio sequence is based on the DC-level value of the bitstream that was being transmitted before the transmission of the control segment starts. The bitstream may be generated by a digital delta-sigma modulator in the receiver with an input of the mean value of the bitstream occurring before the control segment is received.

At step 746, the method 740 switches between the audio sequence generated in step 744 and the original transmitted bitstream based upon the DC-level such that the generated bitstream without the control segment data is provided to a digital-to-analog converter module or a class-D amplifier.

Figure 10:
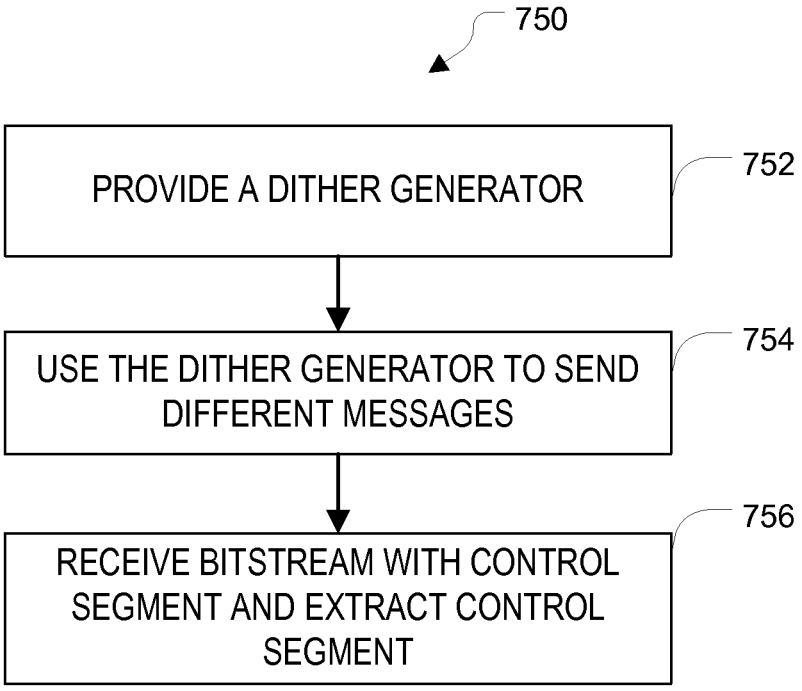
FIG. 10 is a block diagram illustrating a method for reducing audio disturbances associated with the control bits in a bitstream when the bitstream is converted to audio according to various embodiments.

Referring now to FIG. 10, illustrated therein is a method 750 for reducing the audio disturbance associated with control bits in a bitstream according to yet another embodiment.

At step 752, the method 750, provides a delta-sigma modulator having a dither generator. The dither generator, in some embodiments, uses different types of dither for normal operation involving transmitting audio data and transmission of control messages. As an example, during normal operation, the dither generator may be based on a pseudorandom generator.

At step 754, the method 750 is able to send different control messages to a receiver in a second audio unit. That is, the different control messages will be interpreted based on the content such as volume change, power control or audio tuning parameters. In some instances, the control message could also request for information to be sent back from the receiver.

When sending different messages (e.g. a message with information bit zero or one), these messages can be transmitted using two different tones, both outside the audible band. The signals used for messaging may include special spectral shaping to minimize spectral leak to the audible band. In one embodiment, the control messages are transmitted by alternating between two different tones that are inaudible and translating these tones to a serial pattern that will be used as the message.

In the step 756, the receiver receives the bitstream from the transmitter and extracts the control message by monitoring the out-of-band content from the received bitstream. For example, highpass filtering followed by demodulating and lowpass filtering of the received bitstream in the receiver may be applied to recover the out-of-band control messages.

Figure 11:
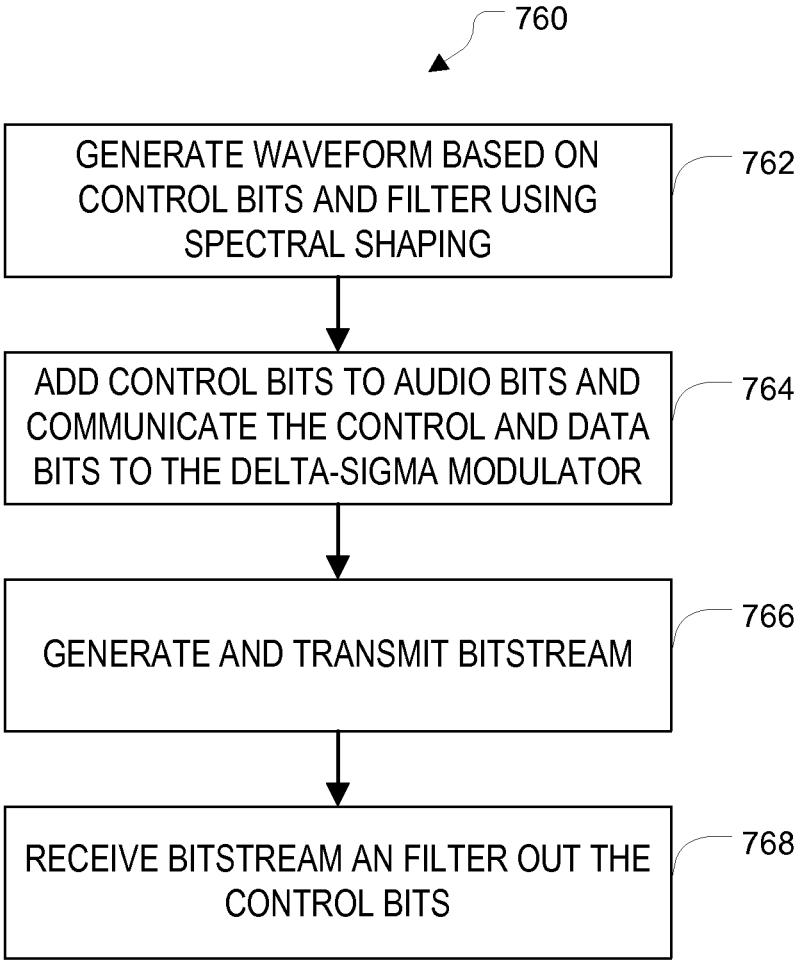
FIG. 11 is a block diagram illustrating a method for reducing audio disturbances associated with the control bits in a bitstream when the bitstream is converted to audio according to various embodiments.

Referring now to FIG. 11, illustrated therein is a method 760 for reducing the audio disturbance associated with control bits in a bitstream according to yet another embodiment.

At step 762, the method 760, generates a waveform based on the control bits and filter using spectral shaping to remove energy in an audio band.

At step 764, the method 760 adds the control bits to the audio bits and communicates the control and data bits to the delta-sigma modulator for transmission.

At step 766, the delta-sigma modulator generates a bitstream comprising the control and audio bits and transmits the bitstream to the second audio unit.

At step 768, the second audio unit receives the bitstream, and filters out the control bits from the bitstream.

Figure 12:
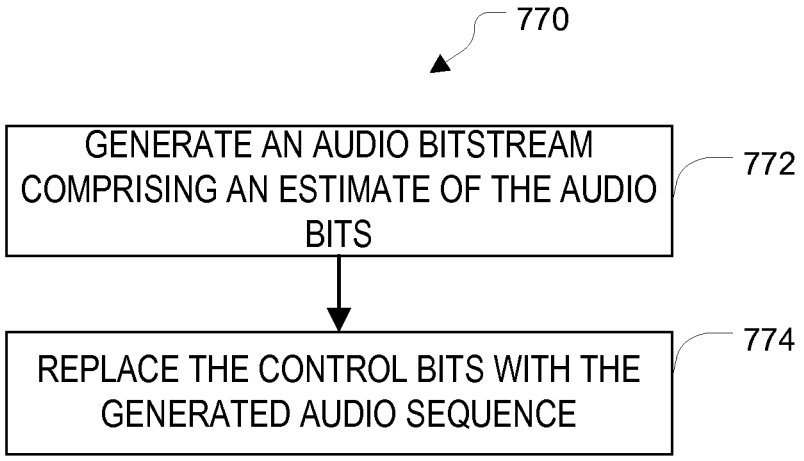
FIG. 12 is a block diagram illustrating a method for reducing audio disturbances associated with the control bits in a bitstream when the bitstream is converted to audio according to various embodiments.

Referring now to FIG. 12, illustrated therein is a method 770 reducing the audio disturbances associated with control bits in a bitstream according to another embodiment.

At step 772, the method 770, generates an audio sequence comprising an estimate of the audio bits that were replaced by the control bits based on audio values before or after the control bits are transmitted.

At step 774, the method 770 replaces the control bits associated with a control segment with the audio sequence generated in step 772 prior to the bitstream being processed by the audio digital-to-analog converter. In order to prevent the control segment from being rendered as an audio disturbance, the receiver may have a buffer to delay the bitstream sufficiently, so that the control bits can be identified and replaced with the audio sequence before being processed and rendered as an audio disturbance.

In some embodiments, the audio sequence in step 772 is generated by copying bits from the audio bitstream immediately before or after (or both) the audio data gap. For example, referring again to FIG. 4, the audio sequence may be a combination of a portion of the bitstream 410*a* immediately before the control segment 450 and a portion of the bitstream 410*b* immediately after the control segment 450. The second processor 335 is further programmed to insert the generated estimate of the audio data in place of the control segment 450 prior to the bitstream being processed by the audio digital-to-analog converter 360.

In some embodiments, the audio sequence in step 772 comprises a first portion followed by a second portion. The sources of the values for the first portion and the second portion may be different. For example, the first portion may include a copy of the audio bits before the control segment and the second portion may include a copy of the audio bits after the control segment.

In some embodiments, the audio sequence in step 772 is generated based on at least one of a linear, parabolic or higher order model of the bitstream, the model being representative of the density of zeros and ones of the bitstream.

In some embodiments, the audio sequence in step 772 is generated based on the properties of the sound pressure produced when the audio bits before or after (or both) the control segment are played back. In some embodiments, the estimate of the audio bits comprises at least one of a linear, parabolic and higher order model of the sound pressure associated with the audio bits in the bitstream.

In some embodiments, the audio sequence in step 772 is generated by obtaining a mean value of the sound associated with the audio bits before or after (or both) the control segment when the audio bits are played back. In some embodiments, the mean value could be a mean of the pressure level of the sound. The mean value could be the mean of the frequency value of the sound. In some embodiments, the mean value could be a mean of any other measured value of the associated sound.

In some embodiments, the audio sequence in step 772 may be generated by generating bits with a similar spectral content as the sound produced by the audio bits before and after the control segment.

In some embodiments, the audio sequence in step 772 may be generated based on at least one of the following adaptive filters: an autoregressive model, a moving average model, and an autoregressive-moving average model of the bitstream. The adaptive filter may be used to generate an audio sequence and the bitstream will be replaced by a model bitstream generated by another adaptive filter and a delta-sigma converter in the receiver when the control segment is received. The adaptive filter may use a white noise source or pseudorandom noise generator as input in this mode of operation.

In some embodiments, the audio sequence in step 772 may be generating by rereading the contents of a buffer as described below and shown in FIG. 13.

Figure 13:
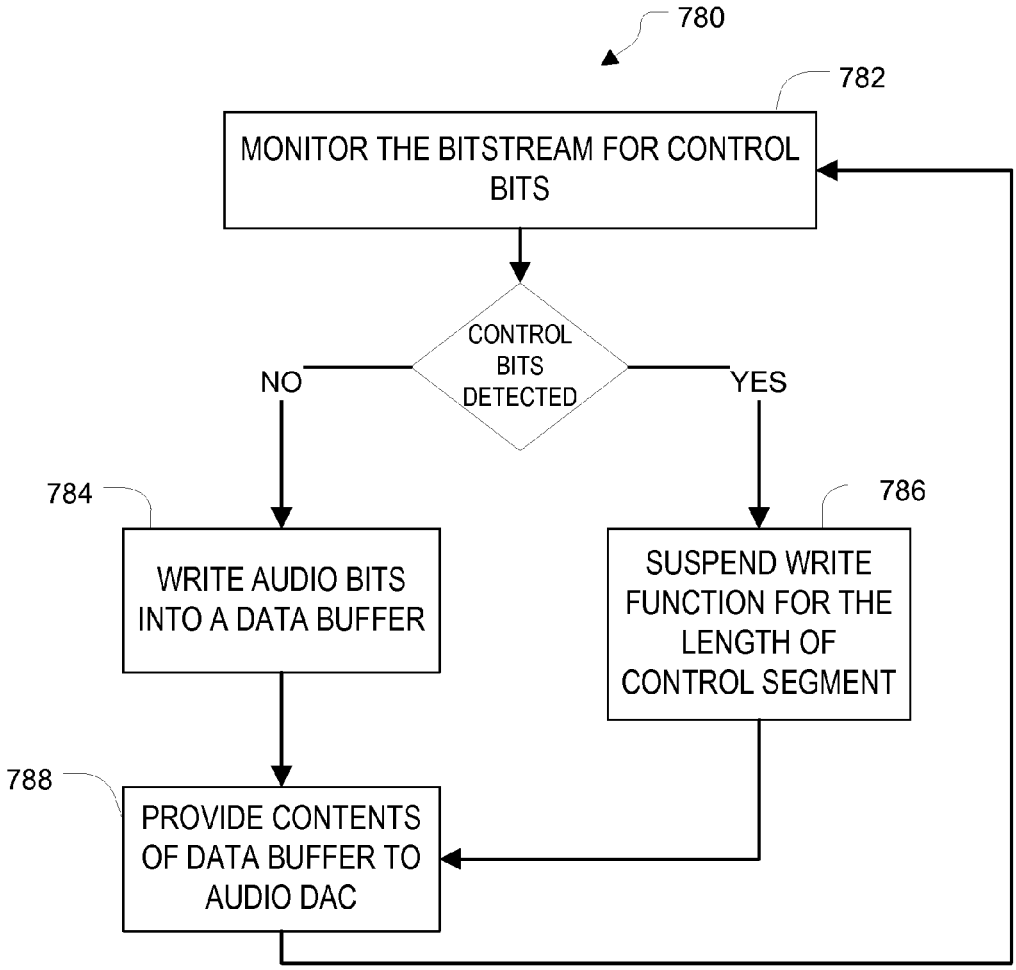
FIG. 13 is a block diagram illustrating a method for reducing audio disturbances associated with the control bits in a bitstream when the bitstream is converted to audio according to various embodiments.

Referring now to FIG. 13, illustrated therein is a method 780 for reducing the audio disturbance associated with control bits in a bitstream according to yet another embodiment.

At step 782, the method 780 monitors the bitstream for the control segment. If the control segment is not detected, the method 780 proceeds to step 784. If the control segment is detected, the method 780 proceeds to step 786.

At step 784, the method 780 writes the audio bits into a data buffer, which may be implemented by a data storage device. In some embodiments, the data buffer may be logically organized in a circular manner (e.g. a circular buffer). In the embodiments when the maximum length of the control segment is known, the amount of data that can be stored in the data buffer could be the same as the maximum length of the control segment.

At step 786, the method 780 suspends the write function such that the control segment is not recorded into the data buffer. The write function may be suspended for the length of the control segment.

At step 788, the method 780 provides the audio bits in the data buffer to an audio digital-to-analog converter by continuously reading from the circular buffer and incrementing the read position to produce the sound associated with the audio bits. Step 788 may be executed continuously and independently from the other steps in the method 780.

Referring now to FIG. 14, illustrated therein is a method 790 for reducing the audio disturbance associated with control bits in digital audio link according to yet another embodiment. This embodiment may be particularly suited for $I^2S$ and PCM digital interface formats.

At step 792, the method 790 divides the control bits in a control segment into a plurality of control subsets, each subset comprising one or more of the bits of the control segment.

At step 794, the method 790 inserts each control subset into an audio word having a defined number of audio bits by replacing at least one of the audio bits in the audio word with the control subset.

At step 796, the method 790 transmits the audio word with the control segment to a second audio unit.

At step 798, the method 790 determines if all of the control subsets of the control segment have been transmitted. If the control subsets have not been transmitted, the method repeats step 794 and step 796 such that the entirety of the control segment is transmitted over a plurality of audio words.

In some embodiments, the method 790 at step 794 inserts the control segments in consecutive audio words. In other embodiments, non-consecutive audio words can carry the control segments.

In some embodiments, the method 790 at step 794 replaces the least significant bit(s) of each audio word with the control subset. Replacing only the least significant bit(s) of an audio word will minimize the distortion of the audio content and make this distortion virtually inaudible.

Referring now to FIG. 15, illustrated therein is a method 800 for reducing the audio disturbance associated with control bits in a bitstream according to yet another embodiment.

At step 802, the method 800 provides an analog control loop that reduces the audio produced by the control bits associated with the control segment when those bits are processed by an audio digital-to-analog converter. This is accomplished by holding the analog value steady during a control segment using a sample-and-hold circuit. During the transmission of the control segment, a delta-sigma converter that receives the bitstream from the transmitter will typically stop the clock so that the control segment does not change the internal state variables, which may be implemented in an analog circuit using charges on capacitors or in a digital manner as saved in digital register values.

At step 804, the analog output is maintained by the idle delta-sigma converter that functions like a sample-and-hold circuit when the clock is gated inactive.

At step 806, after the control segment has been transmitted, the method returns to normal operation.

The foregoing aspects of the method and the electronic device are provided for exemplary purposes only. Those skilled in the art will recognize that various changes may be made thereto without departing from the method and the electronic device as defined by the appended claims.

The invention claimed is:

1. An audio system comprising:

a first audio unit;

a transmitter coupled to the first audio unit;

a receiver coupled to the transmitter;

a second audio unit coupled to the receiver;

a first processor coupled to at least one of the first audio unit and the transmitter, the first processor adapted to convert audio data associated with audio content to a bitstream comprising audio bits associated with the audio content, receive a control command selected from a plurality of control commands, in response, generate a control segment comprising a preamble and control bits associated with the control command, insert the control segment to the bitstream, and transmit the bitstream to the second audio unit using the transmitter;

a second processor coupled to the second audio unit and the receiver, the second processor adapted to monitor the bitstream for the preamble to detect the control segment, and if the control segment is detected, receive the control bits and execute the corresponding control command; and an audio digital-to-analog converter connected to the second processor and adapted to process the bitstream to produce audio associated with the bitstream;

wherein at least one of the first processor and the transmitter is adapted to change the oversampling frequency to a selected value while the control segment is being transmitted to generate sufficient bandwidth to send the control segment concurrently with the audio data.

2. The audio system of claim 1, wherein at least one of the transmitter and receiver comprises a delta-sigma modulator.

3. The audio system of claim 2 wherein each of the transmitter and the receiver comprises a delta-sigma modulator, the delta-sigma modulator in the transmitter being configured to change the oversampling value to the selected value, and the delta-sigma modulator in the receiver is configured to change the oversampling value to the same value as the selected value to receive the control segment, the selected value being a oversampling value at which the control segment is transmitted outside the audible band.

4. The audio system of claim 3, wherein the transmitter is operable to signal to the receiver that the oversampling frequency is changed to the selected value by sending a series of audio bits in a predefined pattern in the bitstream, and the receiver is operable to monitor the bitstream for that pattern to determine that the oversampling frequency has been changed.

5. The audio system of claim 4, wherein the transmitter is operable to detect audio bits that are identical to the predefined pattern and change at least one of these audio bits before they are transmitted such that these audio bits will not be misinterpreted an indicator of the change in oversampling frequency.

6. The audio system of claim 4, wherein the dither generator is operable to provide special spectral shaping to minimize spectral leak to the audible band.

7. The audio system of claim 2 wherein each of the transmitter comprises a sample-rate converter connected to the delta-sigma converter to receive output from the delta-sigma converter, the sample rate converter operable to change the oversampling frequency value to the selected value and a second value larger than the selected value, the selected value being used when control segment is being transmitted and the second value being used when control segment is not being transmitted to improve signal to noise ratio range when control segment is not being transmitted.

8. The audio system of claim 2, wherein the delta-sigma modulator comprises a dither generator, the dither generator being configured to send the control segment to the receiver outside the audio band such that the control segment will be inaudible when it is processed by the audio digital-to-analog converter.

9. The audio system of claim 1 wherein the first processor is further configured to divide the control segment into a plurality of control subsets and transmit the control subsets at selected intervals in the bitstream, and the second processor is configured to monitor the bitstream at the interval for the control subsets to reconstruct the control segment.

10. The audio system of claim 9, where each control subset is one bit and each the control subset is inserted into the bitstream for each audio bit such that the selected interval occurs every second bit in the bitstream while the control segment is being transmitted.

11. The audio system of claim 1, wherein the second audio unit further comprises an analog control loop that reduces the audio disturbance produced by the control bits associated with the control segment when those bits are processed by the audio digital-to-analog converter.

12. The audio system of claim 1, wherein the transmitter and the receiver are configured to communicate via a bitstream interface consisting two terminals, the two terminals being a bit clock and a data line.

13. The audio system of claim 1, wherein the transmitter and the receiver are configured to communicate via a bitstream interface consisting three terminals, the three terminals being a bit clock, a word select and a data line.

14. The audio system of claim 1, where the transmitter is operable to detect audio bits that are identical to the preamble and change at least one of these audio bits before they are transmitted such that these audio bits will not be misinterpreted as the preamble by the receiver.

15. The audio system of claim 1, wherein the control segment is inserted into the bitstream by replacing at least some of the audio bits in the bitstream.

16. The audio system of claim 1, wherein the control segment is inserted into the bitstream without replacing at least some of the audio bits in the bitstream.

17. A method for encoding control messages in an audio system, comprising:

converting audio data associated with an audio content to a bitstream comprising audio bits associated with the audio content;

receiving a control command selected from a plurality of control commands;

in response to the control command, generating a corresponding control segment comprising a preamble and control bits associated with the control command;

changing the oversampling value to a selected value while the control segment is being transmitted to generate sufficient bandwidth to transmit the control segment concurrently with the audio data in the bitstream;

inserting the control segment to the bitstream;

transmitting the bitstream using a transmitter to a second audio unit;

receiving the bitstream at the second audio unit using a receiver;

monitoring the bitstream for bits associated with the preamble to detect the control segment;

if the control segment is detected by monitoring the bitstream, then processing the control message and executing the corresponding control command; and converting the bits in the bitstream to audio using an audio digital-to-analog converter connected to the second processor, operable to process the bits in the bitstream to produce audio associated with the bits in the bitstream.

18. The method of claim 17, wherein the bitstream is transmitted via a first delta-sigma modulator by the first audio unit and the bitstream is received via a second delta-sigma modulator at the second audio unit.

19. The method of claim 17, further comprising changing the oversampling value to the selected value, and the delta-sigma modulator in the receiver is configured to change the oversampling value to the same value as the selected value to receive the control segment, the selected value being a oversampling value at which the control segment is transmitted outside the audible band.

20. The method of claim 17, further comprising sending a series of audio bits in a predefined pattern in the bitstream to indicate that to the receiver that the oversampling value is changed.

* * * * *